US012070833B2

(12) United States Patent
Chen et al.

(10) Patent No.: US 12,070,833 B2
(45) Date of Patent: Aug. 27, 2024

(54) METHOD OF USING POLISHING PAD

(71) Applicant: TAIWAN SEMICONDUCTOR MANUFACTURING COMPANY, LTD., Hsinchu (TW)

(72) Inventors: Chunhung Chen, Hsinchu (TW); Jung-Yu Li, Hsinchu (TW); Sheng-Chen Wang, Hsinchu (TW); Shih-Sian Huang, Hsinchu (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 0 days.

(21) Appl. No.: 18/341,421

(22) Filed: Jun. 26, 2023

(65) Prior Publication Data

US 2023/0339068 A1 Oct. 26, 2023

Related U.S. Application Data

(62) Division of application No. 16/952,901, filed on Nov. 19, 2020, now Pat. No. 11,691,243, which is a (Continued)

(51) Int. Cl.
*B24B 37/24* (2012.01)
*B24B 37/005* (2012.01)
(Continued)

(52) U.S. Cl.
CPC ..... *B24B 37/26* (2013.01); *B24B 37/005* (2013.01); *B24B 37/10* (2013.01); *B24B 37/22* (2013.01);
(Continued)

(58) Field of Classification Search
CPC ..... B24B 37/005; B24B 37/10; B24B 37/22; B24B 37/24; B24B 37/26; B24B 49/12; B24B 53/017
(Continued)

(56) References Cited

U.S. PATENT DOCUMENTS 5,913,713 A * 6/1999 Cheek ..... B24B 37/26 451/6
6,126,532 A * 10/2000 Sevilla ..... B24B 37/24 451/526
(Continued)

FOREIGN PATENT DOCUMENTS

CN 115070606 B * 11/2023 ..... B24B 37/10
JP 2004327567 A * 11/2004
WO WO-2010005702 A1 * 1/2010 ..... B24B 37/12

*Primary Examiner* — Eileen P Morgan
(74) *Attorney, Agent, or Firm* — Hauptman Ham, LLP

(57) ABSTRACT

A method of using a polishing pad includes applying a slurry to a first location on the polishing pad. The method further includes rotating the polishing pad. The method further includes spreading the slurry across a first region of the polishing pad at a first rate, wherein the first region includes a plurality of first grooves. The method further includes spreading the slurry across a second region, surrounding the first region of the polishing pad at a second rate different from the first rate, wherein the second region includes a plurality of second grooves. The method further includes spreading the slurry across a third region, surrounding the second region of the polishing pad at a third rate less than the first rate and the second rate, wherein the third region includes a plurality of third grooves.

12 Claims, 8 Drawing Sheets

Related U.S. Application Data division of application No. 15/647,444, filed on Jul. 12, 2017, now Pat. No. 10,864,612.

(60) Provisional application No. 62/434,224, filed on Dec. 14, 2016.

(51) Int. Cl.

| | |
|---|---|
| ***B24B 37/10*** | (2012.01) |
| ***B24B 37/22*** | (2012.01) |
| ***B24B 37/26*** | (2012.01) |
| ***B24B 49/12*** | (2006.01) |
| ***B24B 53/017*** | (2012.01) |

(52) U.S. Cl.
CPC ..... *B24B 37/24* (2013.01); *B24B 49/12* (2013.01); *B24B 53/017* (2013.01)

(58) Field of Classification Search
USPC ..... 451/527, 529
See application file for complete search history.

(56) References Cited

U.S. PATENT DOCUMENTS 6,169,931 B1 * 1/2001 Runnels ..... B24B 37/26 700/121
6,203,407 B1 * 3/2001 Robinson ..... B24D 13/142 451/527
6,520,847 B2 * 2/2003 Osterheld ..... B24B 37/26 451/529
6,692,338 B1 * 2/2004 Kirchner ..... B24B 37/26 451/60
7,553,214 B2 * 6/2009 Menk ..... B24B 21/04 451/6
9,687,956 B2 * 6/2017 Tsai ..... B24B 37/26
9,993,907 B2 * 6/2018 Murugesh ..... B33Y 70/00
10,040,167 B2 * 8/2018 Chen ..... B24B 37/22
2001/0029157 A1 * 10/2001 Chopra ..... B24D 3/28 451/527
2002/0025760 A1 * 2/2002 Lee ..... B23H 5/08 451/36
2002/0111120 A1 * 8/2002 Goetz ..... B24B 37/22 451/527
2005/0136804 A1 * 6/2005 Miyake ..... B24B 37/042 451/41
2005/0272348 A1 * 12/2005 Min ..... B24B 37/20 451/11
2006/0252266 A1 * 11/2006 Lee ..... B24B 37/26 438/692
2006/0283839 A1 * 12/2006 Saito ..... B24B 37/26 438/692
2009/0311955 A1 * 12/2009 Kerprich ..... B24B 37/26 451/527
2010/0003904 A1 * 1/2010 Duescher ..... B24B 37/245 51/293
2010/0015895 A1 * 1/2010 Hendron ..... B24B 37/24 57/402
2011/0300776 A1 * 12/2011 Mai ..... B24B 37/042 451/28
2012/0190281 A1 * 7/2012 Allison ..... B24D 11/001 51/296
2013/0137350 A1 * 5/2013 Allison ..... B24B 37/16 451/550
2013/0324020 A1 * 12/2013 Lefevre ..... B24B 37/16 451/529
2015/0079886 A1 * 3/2015 Schutte ..... B24B 37/26 451/527
2015/0174826 A1 * 6/2015 Murugesh ..... B33Y 70/00 264/308
2015/0298287 A1 * 10/2015 Tsai ..... B24B 37/26 451/527
2015/0367478 A1 * 12/2015 Lefevre ..... B24B 37/205 451/526
2016/0107288 A1 * 4/2016 Orilall ..... B24B 37/24 451/529
2016/0144477 A1 * 5/2016 Scott ..... B24B 37/22 451/538
2016/0221145 A1 * 8/2016 Huang ..... B24B 37/24
2016/0229025 A1 * 8/2016 Roy ..... B24D 7/14
2017/0120417 A1 * 5/2017 Lefevre ..... B24B 37/22
2017/0259396 A1 * 9/2017 Yamamura ..... B24B 37/20
2018/0141183 A1 * 5/2018 Scott ..... B24D 18/0072
2018/0236632 A1 * 8/2018 Murugesh ..... B24B 37/24
2022/0097198 A1 * 3/2022 Wong ..... B24B 37/105
2023/0008720 A1 * 1/2023 Ito ..... B24B 37/042

* cited by examiner

METHOD OF USING POLISHING PAD

RELATED APPLICATIONS

This application is a divisional of U.S. application Ser. No. 16/952,901 filed Nov. 19, 2020, which is a divisional application of U.S. application Ser. No. 15/647,444, filed Jul. 12, 2017, now U.S. Pat. No. 10,864,612, issued Dec. 15, 2020, which claims priority to Provisional U.S. Application No. 62/434,224, filed Dec. 14, 2016, all of which are hereby incorporated by reference in their entireties.

BACKGROUND

Chemical mechanical polishing (CMP) processes are widely used in semiconductor manufacturing processes for removing material from a surface of a wafer and producing a planarized surface. The CMP processes use a combined action of a polishing pad and a slurry for removing material from the wafer. The slurry helps to breakdown an exposed material of the wafer in order to help with mechanical removal of the exposed material by the polishing pad.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
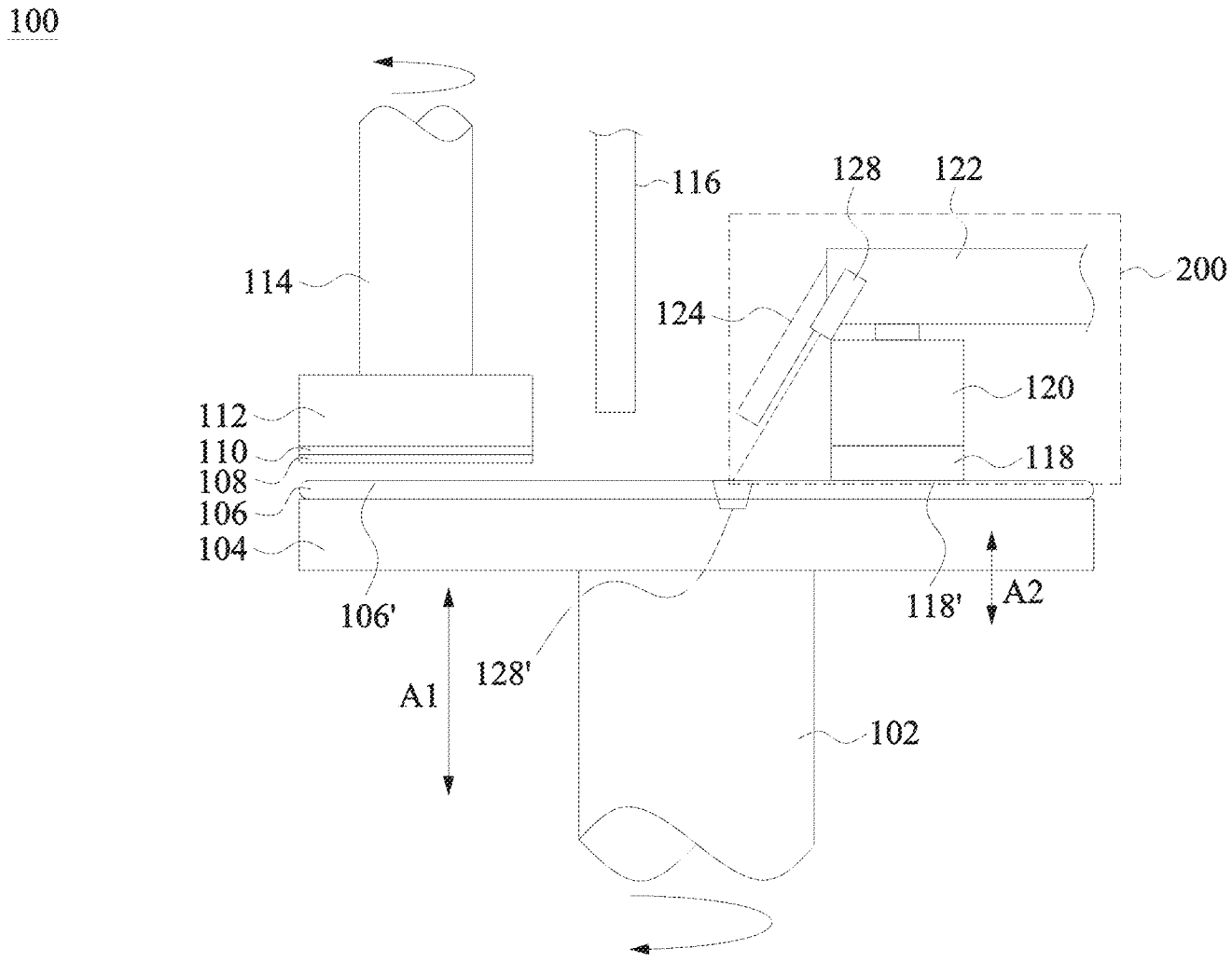
FIG. 1 is a side view of a CMP apparatus, in accordance with some embodiments of the present disclosure.

The following disclosure provides many different embodiments, or examples, for implementing different features of the provided subject matter. Specific examples of components, materials, values, steps, operations, materials, arrangements, or the like, are described below to simplify the present disclosure. These are, of course, merely examples and are not intended to be limiting. Other components, values, operations, materials, arrangements, or the like, are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90° or at other specified orientations) and the spatially relative descriptors used herein may likewise be interpreted accordingly.

Polishing pads are used during chemical mechanical polishing (CMP) processes for manufacturing semiconductor devices. A planarization process includes depositing a solution, called a slurry, onto the polishing pad; pressing a wafer against the polishing pad; and moving and/or rotating the wafer relative to the polishing pad. The polishing pad is moved and/or rotate relative to the wafer. In some embodiments, both the wafer and the polishing pad are rotated and/or translated during the CMP process. The slurry helps to break down or soften a material on the wafer in order to permit the polishing pad to more easily remove the material by a mechanical grinding process. Uniform distribution of slurry across the polishing pad helps to increase uniformity of the planarization process and increase production yield of the manufacturing process.

During planarization processes, rotation of the polishing pad helps to spread the slurry to the edges of the polishing pad. Slurry at the edge of the polishing pad is cast off the polishing pad by the rotation of the polishing pad. This slurry is capable of being cleaned and recycled for reuse in a same or a later planarization process.

A faster rotation rate of the polishing pad helps to increase the rate of transfer of the slurry to the periphery of the polishing pad; however, the faster rotation rate also increases an amount of slurry cast off during the CMP process. In order to increase uniformity of slurry distribution, while reducing an amount of slurry cast off during the CMP process, a polishing pad having multiple regions is used with each region having different geometric and/or material properties.

In some embodiments, combinations of geometric properties vary between different regions. For example, in some embodiments, a central region of the polishing pad closest to a center of the polishing pad has a first groove pitch, a first groove width and a first groove depth; a transfer region of the polishing pad between the central region and an edge of the polishing pad has the first groove pitch, a second groove width and a second groove depth; and a retention region of the polishing pad between the transfer region and the edge of the polishing pad has a second groove pitch, the second groove width and a third groove depth. Other combinations of geometric properties are also contemplated.

In addition to changing geometric properties, material properties of the polishing pad are also capable of varying between different regions of the polishing pad. In some embodiments, the material properties include specific gravity, porosity, or absorbance. As specific gravity increases, a rate of slurry spread across the polishing pad decreases. Porosity and absorbance also have an inverse relationship with a rate of slurry spread across the polishing pad.

In some embodiments, the material properties of the polishing pad vary in a radial direction from the center of the polishing pad to the edge of the polishing pad. In some embodiments, the material properties of the polishing pad vary in a thickness direction of the polishing pad, perpendicular to the top surface of the polishing pad. In some embodiments, the changes in the material properties are caused by a change in a material used to make the polishing pad. In some embodiments, the changes in the material properties are caused by using a same material formed using different manufacturing process in the different regions of the polishing pad.

In some embodiments, a combination of geometric properties and material properties varies across the regions of the polishing pad. For example, in some embodiments, the central region of the polishing pad has a first specific gravity and a first groove depth; the transfer region of the polishing pad has the first specific gravity and a second groove depth; the retention of the polishing pad has a second specific gravity and the second groove depth. Other combinations of geometric properties and material properties are also contemplated.

Spreading the slurry across the polishing pad fast enough to assist with material removal at an edge of a wafer; and maintaining the slurry at the edge of the polishing pad help to provide consistent contact between the slurry and the wafer during the planarization process. The consistent contact between the slurry and the wafer helps to soften the material to be planarized across an entirety of the wafer. As a result, a pressure exerted between the wafer and the polishing pad during the planarization process is decreased in comparison with planarization processes which use uniform polishing pad designs. The decreased pressure results in less damage to the polishing pad during the planarization process. As a result, a useful life of the polishing pad is increased in comparison with uniform polishing pad designs and manufacturing costs are reduced. In addition, the decreased pressure also reduces a risk of damage to the wafer during the planarization process, which increases production yield. The consistent contact between the slurry and wafer achieved by the multiple region polishing pad described above also helps to provide a more uniform planarization process and reduces dishing and other effects of the planarization process which increase manufacturing costs and/or reduce production yield. In addition, the retention region helps to keep slurry from being cast off during the CMP process, which reduces an amount of slurry used during the CMP process in order to provide reduced manufacturing costs. In addition to reducing an amount of slurry used during the CMP process, an amount of materials used to recycle or clean the slurry is also reduced as a result of less slurry entering the recycling process.

FIG. 1 is a side view of a CMP apparatus 100 in accordance with some embodiments. CMP apparatus 100 includes a rotatable shaft 102 supporting a platen 104 with a polishing pad 106 secured to the platen. Polishing pad 106 includes at least one transfer region and a retention region. In some embodiments, polishing pad 106 is secured to plate 104 by an adhesive layer. In some embodiments, a support layer configured to enhance rigidity of polishing pad 106 is included between the polishing pad 106 and plate 104, e.g., within the adhesive layer or between separate adhesive layers. Platen 104 rotates in at least a first direction of rotation about a first axis A1 at one or more rotational speeds suitable for CMP operations. A wafer carrier 112 supports a wafer 108 to be subjected to a CMP process. A backing film 110 between wafer carrier 112 and wafer 108 helps to secure the wafer 108 in the wafer carrier 112. Wafer carrier 112 positions wafer 108 on a polishing surface 106' of polishing pad 106.

Wafer carrier 112 is supported by a movable and rotatable shaft 114 through which a force is applied along a first axis A1 to press an exposed wafer surface against polishing surface 106' of polishing pad 106. In some embodiments, the first axis A1 is perpendicular to the polishing surface 106'. Wafer carrier 112 rotates in at least a second direction at one or more rotational speeds suitable for CMP operations while the exposed wafer surface is in contact with rotating polishing pad 106. A slurry dispenser 116 dispenses a flow of slurry onto one or more dispense locations on polishing surface 106'. Rotation of polishing pad 106 helps to spread the slurry from slurry dispenser 116.

CMP apparatus 100 includes a conditioning apparatus 200 including a conditioning pad 118 supported on a conditioning head 120 that is fixed to a support arm 122. Conditioning pad 118 rotates about a second axis A2. In some embodiments, the first axis A1 and the second axis A2 are both perpendicular to pad surface 106' and offset in a direction parallel to the polishing surface 106'. In some embodiments, at least one of first axis A1 or second axis A2 is angled with a normal line of polishing surface 106'. Movement of support arm 122 brings the conditioning pad 118 into contact with polishing surface 106'.

In some embodiments, the support arm 122 also provides axial and/or arcuate movement of the conditioning head 120 in a plane above and generally parallel to polishing surface 106' of along a path from a first position to a second position. In some embodiments, movement of the support arm 122 produces axial and/or arcuate movement of conditioning pad 118 In some embodiments, an exposed conditioning surface 118' of conditioning pad 118 includes a grit material, e.g., diamond grit, embedded in a polymer matrix.

In some embodiments, the conditioning apparatus includes a flush solution dispenser 124 for assisting with debris removal from polishing pad surface 106' during a conditioning process. In some embodiments, the conditioning apparatus includes a surface condition scanner 128, e.g., an optical scanner, for evaluating a surface condition, e.g., roughness, of a scanned area 128' on the polishing surface 106'.

In some embodiments, exposed conditioning surface 118' includes other suitable materials such as scouring materials or bristles, such as a brush. In some embodiments, conditioning pad 118 does not rotate so that movement of the conditioning pad 118 relative to the polishing pad 106 results only from a rotation of polishing pad 106 and movement of support arm 122.

Figure 2:
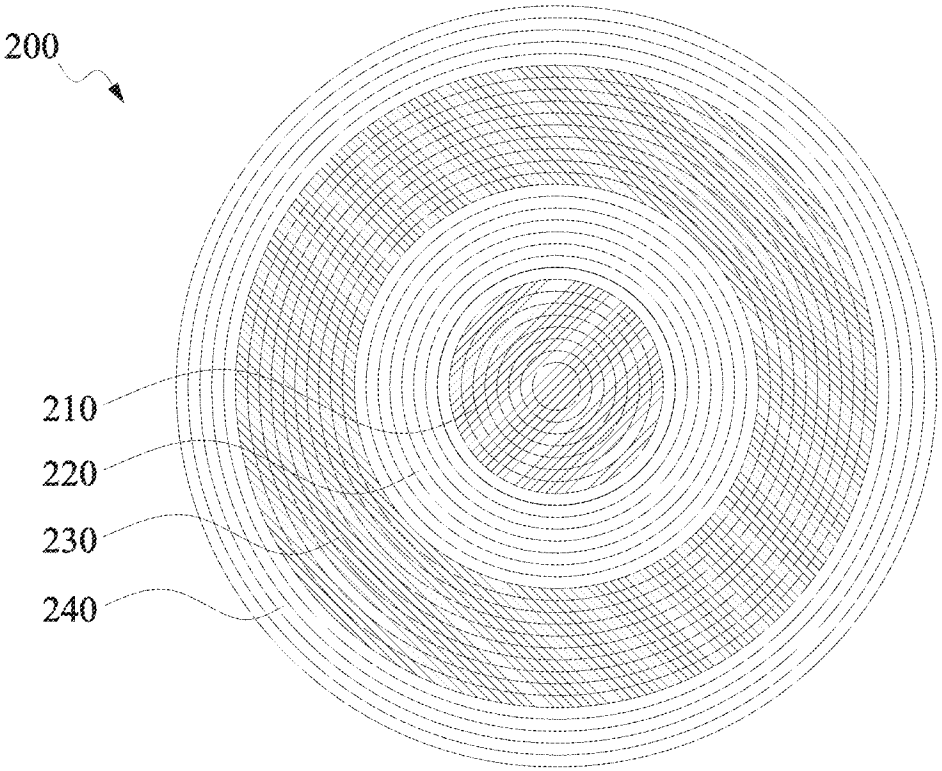
FIG. 2 is a plan view of a polishing pad, in accordance with some embodiments of the present disclosure.

FIG. 2 is a plan view of a polishing pad 200 in accordance with some embodiments. Polishing pad 200 includes a central region 210. A first transfer region 220 surrounds central region 210. A second transfer region 230 surrounds first transfer region 220. A retention region 240 surrounds second transfer region 230. In some embodiments, one of first transfer region 220 or second transfer region 230 is omitted and only one transfer region is present between central region 210 and retention region 240. In some embodiments, polishing pad 200 includes more than two transfer regions.

Central region 210 has a first set of geometric and material properties. Geometric properties include groove depth, groove pitch, groove width and other suitable geometric properties. Material properties include specific gravity, porosity, absorbance and other suitable material properties. The first set of geometric and material properties is selected to receive a slurry and assist with transfer of the slurry toward an edge of polishing pad 200. In some embodiments, the first set of geometric and material properties are uniform across an entirety of central region 210. In some embodiments, the first set of geometric and material properties vary across central region 210.

First transfer region 220 has a second set of geometric and material properties. The second set of geometric and material properties is selected to help increase a rate of transfer of a slurry toward the edge of polishing pad 200. At least one of the geometric properties or material properties of first transfer region 220 differs from the first set of material properties in central region 210. In some embodiments, multiple geometric properties or material properties are different between the first set of geometric and material properties and the second set of geometric and material properties. In some embodiments, all geometric and material properties are different between the first set of geometric and material properties and the second set of geometric and material properties.

Second transfer region 230 has a third set of geometric and material properties. The third set of geometric and material properties is selected to help increase a rate of transfer of a slurry toward the edge of polishing pad 200. At least one of the geometric properties or material properties of second transfer region 230 differs from the second set of material properties in first transfer region 220. In some embodiments, multiple geometric properties or material properties are different between the third set of geometric and material properties and the second set of geometric and material properties. In some embodiments, all geometric and material properties are different between the third set of geometric and material properties and the second set of geometric and material properties.

Retention region 240 has a fourth set of geometric and material properties. The fourth set of geometric and material properties is selected to help retain the slurry and reduce cast off of slurry from the edge of polishing pad 200. At least one of the geometric properties or material properties of retention region 240 differs from the third set of material properties in second transfer region 230. In some embodiments, multiple geometric properties or material properties are different between the third set of geometric and material properties and the fourth set of geometric and material properties. In some embodiments, all geometric and material properties are different between the third set of geometric and material properties and the fourth set of geometric and material properties.

A relative size of central region 210, first transfer region 220, second transfer region 230 and retention region 240 is selected based on a number of factors. The factors include a size of a wafer to be polished, a size of polishing pad 200, properties of a slurry material, a removal rate of a CMP process, a rotation rate of polishing pad 200 during the CMP process, combinations of the above factors or other suitable factors. As a size of the wafer to be polished increases, a relative size of the retention region 240 increases, in some embodiments, in order to hold slurry material against the wafer for a longer period of time. As a size of polishing pad 200 increases, a relative size of first transfer region 220 or second transfer region 230 increases, in some embodiments, in order to assist with rapid spreading of the slurry across polishing pad 200. As a slurry material becomes more difficult to spread, e.g., an increase in viscosity, a relative size of first transfer region 220 or second transfer region 230 increases, in some embodiments, in order to assist with spreading the slurry across polishing pad 200. As a removal rate of the CMP process increases, a relative size of the first transfer region 220 or second transfer region 230 increases, in some embodiments, to help ensure that sufficient slurry is present in an area of polishing pad 200 where the wafer is to be processed at a beginning of the CMP process. As a rotation rate of polishing pad 200 increases, a relative size of first transfer region 220 or second transfer region 230 decreases, in some embodiments, because the higher rotation rate provides sufficient ability to spread the slurry.

In some embodiments, a diameter of central region 210 ranges from about 1% to about 99% of a diameter of polishing pad 200. In some embodiments, the diameter of central region 210 ranges from about 5% to about 40% of the diameter of the polishing pad 200. In some embodiments, a difference between an inner diameter of first transfer region 220 and an outer diameter of first transfer region 220 ranges from about 1% to about 99% of a diameter of polishing pad 200. In some embodiments, the difference between the inner diameter of first transfer region 220 and the outer diameter of first transfer region 220 ranges from about 5% to about 40% of the diameter of the polishing pad 200. In some embodiments, a difference between an inner diameter of second transfer region 230 and an outer diameter of second transfer region 230 ranges from about 1% to about 99% of a diameter of polishing pad 200. In some embodiments, the difference between the inner diameter of second transfer region 230 and the outer diameter of second transfer region 230 ranges from about 5% to about 40% of the diameter of the polishing pad 200. In some embodiments, a difference between an inner diameter of retention region 240 and an outer diameter of retention region 240 ranges from about 1% to about 99% of a diameter of polishing pad 200. In some embodiments, the difference between the inner diameter of retention region 240 and the outer diameter of retention region 240 ranges from about 5% to about 40% of the diameter of the polishing pad 200.

Figure 3:
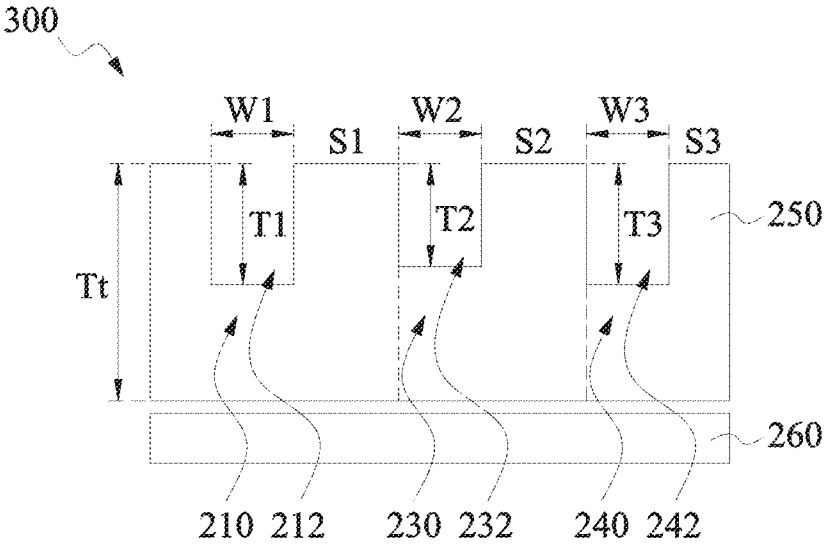
FIG. 3 is a cross-sectional view of a polishing pad, in accordance with some embodiments of the present disclosure.

FIG. 3 is a cross-sectional view of a portion of a polishing pad 300, in accordance with some embodiments. Polishing pad 300 is similar to polishing pad 200 and same reference numbers refer to same elements. In comparison with polishing pad 200, first transfer region 220 is omitted in polishing pad 300. The cross-sectional view of polishing pad 300 is of one half the diameter of polishing pad 300 and excludes portions of polishing pad 300 for the sake of clarity. One of ordinary skill in the art would understand that each region of polishing pad 300 would have more than a single groove, in some embodiments. Polishing pad 300 includes a pad 250 attached to an adhesive layer 260. A total thickness Tt of pad 250 ranges from about 5 millimeters (mm) to about 30 mm. A first groove 212 is located in central region 210. First groove 112 has a groove depth T1, a groove width W1, and a groove pitch S1 between adjacent grooves in central region 210. A second groove 232 is located in second transfer region 230. Second groove 232 has a groove depth T2, a groove width W2, and a groove pitch S2 between adjacent grooves in second transfer region 230. A third groove 242 is located in retention region 240. Third groove 242 has a groove depth T3, a groove width W3, and a groove pitch S3 between adjacent grooves in retention region 240.

In some embodiments, depth T1 is equal to at least one of depth T2 or depth T3. In some embodiments, depth T1 is different from both depth T2 and depth T3. In some embodiments, a maximum depth of any of depth T1, depth T2 and depth T3 is half of total thickness Tt. In some embodiments, depth T1 ranges from about 0.4 Tt to about 0.6 Tt. In some embodiments, depth T2 ranges from about 0.2 Tt to about 0.4 Tt. In some embodiments, depth T3 ranges from about 0.4 Tt to about 0.6 Tt. A reduced depth T2 in comparison with depth T3 means a lower volume of second groove 232 in comparison with a value of third groove 242. The reduced volume means that less slurry is used to fill second groove 232 in comparison with third groove 242 in order to help the slurry to spread to an edge of polishing pad 300 rapidly. Conversely, the increased volume of third groove 242 helps to hold slurry in retention region 240 to reduce slurry cast off at edge of polishing pad 300.

In some embodiments, width W1 is equal to at least one of width W2 or width W3. In some embodiments, width W1 is different from both width W2 and width W3. In some embodiments, each of width W1, width W2 or width W3 independently ranges from about 1 mm to about 5 mm. In some embodiments, a smaller width W2 in comparison with width W3 reduces a volume of second groove 232 in comparison with third groove 242 to help achieve the above-mentioned effects.

In some embodiments, pitch S1 is equal to at least one of pitch S2 or pitch S3. In some embodiments, pitch S1 is different from both pitch S2 and pitch S2. In some embodiments, each of pitch S1, pitch S2 or pitch S3 independently ranges from about 1 mm to about 5 mm. In some embodiments, a larger pitch S2 in comparison with pitch S3 reduces a total number of grooves in second transfer region 230 in comparison with retention region 240. As a result, slurry spreads across second transfer region 230 faster than across retention region 240 to help achieve the above-mentioned effects.

Polishing pad 300 includes sidewalls of first groove 212, second groove 232 and third groove 242 being substantially perpendicular to a top surface of pad 250. In some embodiments, at least one of first groove 212, second groove 232 or fourth groove 242 has tapered sidewalls that are angled with respect to the top surface of pad 250. Tapered sidewalls also impact a volume of grooves of polishing pad 300 to help enhance the effects discussed above.

In some embodiments, which include first transfer region 220, grooves of first transfer region 220 have at least one different geometric parameter from grooves of second transfer region 230. For example, in some embodiments, a depth of grooves of first transfer region 220 is different from depth T2. In some embodiments, grooves of one of first transfer region 220 or grooves of second transfer region 230 have tapered sidewalls and grooves of the other of first transfer region 220 or second transfer region 230 have substantially perpendicular sidewalls.

In addition to the geometric properties discussed above, material properties for polishing pad 300 vary across the polishing pad in some embodiments. The material properties include specific gravity, porosity, absorbance or other suitable material properties. Adjusting material properties of polishing pad 300 also impacts the spread of slurry across polishing pad 300.

Specific gravity is a ratio of a density of a material of polishing pad 300 in comparison with a density of water. As specific gravity of the material of polishing pad 300 increases, a useful life of polishing pad 300 also increases. Differences in specific gravity of polishing pad 300 also impacts spread of slurry across polishing pad 300 because a denser material is less likely to permit slurry to penetrate into the material of polishing pad 300. In addition, a higher specific gravity will increase material removal rate during a CMP process, in some instances. In some embodiments, specific gravity is substantially constant across an entirety of polishing pad 300. In some embodiments, a specific gravity of each of central region 210, second transfer region 230 and retention region 240 independently ranges from about 0.5 to about 1.9. In some embodiments, central region 210 has a lower specific gravity than both of second transfer region 230 and retention region 240. In some embodiments, second transfer region 230 has a lower specific gravity than retention region 240.

Porosity and/or absorbance of the material of polishing pad 300 help determine how slurry spreads across polishing pad 300. As porosity and/or absorbance increases, the spread of slurry is slowed because more slurry penetrates the pores or is absorbed by the material of polishing pad 300. In some embodiments, porosity and/or absorbance of the material of polishing pad 300 is substantially uniform across polishing pad 300. In some embodiments, the porosity of the material of polishing pad 300 ranges from about 0.1% to about 60%. If the porosity is too small, slurry is easily cast off during the CMP process, in some instances. If the porosity is too high, slurry does not to spread uniformly across polishing pad 300, in some instances. In some embodiments, central region 210 has a lower porosity and/or absorbance than both second transfer region 230 and retention region 240. In some embodiments, second transfer region 230 has a lower porosity and/or absorbance than retention region 240.

In some embodiments, which include first transfer region 220, first transfer region 220 has at least one different material parameter from second transfer region 230. For example, in some embodiments, a porosity of first transfer region 220 is different from a porosity of second transfer region 230.

Figure 4:
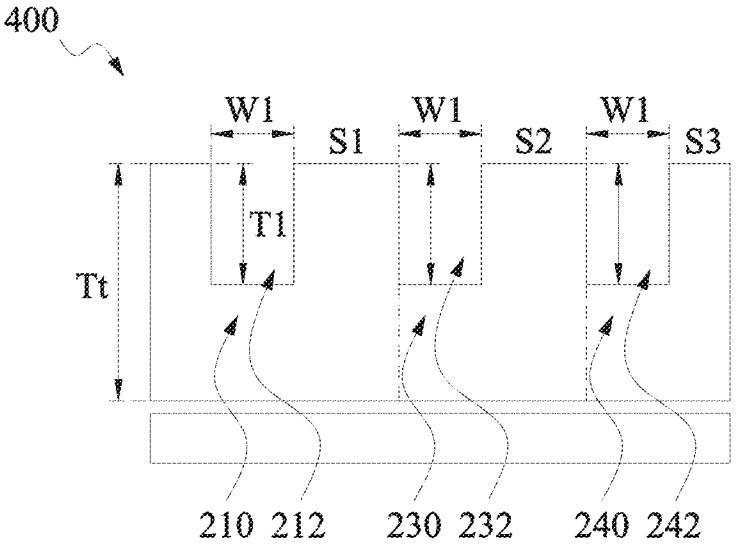
FIG. 4 is a cross-sectional view of a polishing pad, in accordance with some embodiments of the present disclosure.

FIG. 4 is a cross-sectional view of a portion of a polishing pad 400, in accordance with some embodiments. Polishing pad 400 is similar to polishing pad 300 and same reference numbers refer to same elements. The cross-sectional view of polishing pad 400 excludes portions of polishing pad 400 for the sake of clarity. One of ordinary skill in the art would understand that each region of polishing pad 400 would have more than a single groove, in some embodiments. In comparison with polishing pad 300, polishing pad 400 includes each of first groove 212, second groove 232 and third groove 242 having a same depth T1 and a same width W1. Pitch S1 in central region 210 is different from at least one of pitch S2 or pitch S3. Pitch S2 is greater than pitch S3. Impacts of the geometric properties in polishing pad 400 are similar to those discussed above with respect to polishing pad 300 and are omitted here for the sake of brevity.

Figure 5:
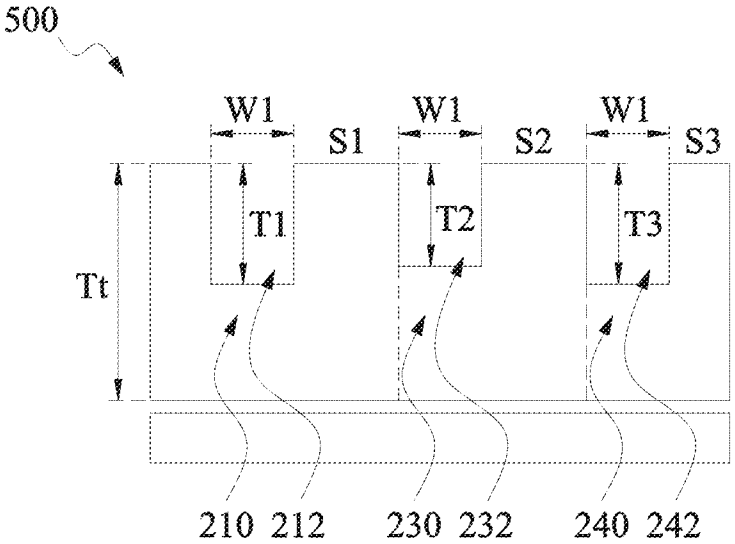
FIG. 5 is a cross-sectional view of a polishing pad, in accordance with some embodiments of the present disclosure.

FIG. 5 is a cross-sectional view of a portion of a polishing pad 500, in accordance with some embodiments. Polishing pad 500 is similar to polishing pad 300 and same reference numbers refer to same elements. The cross-sectional view of polishing pad 500 excludes portions of polishing pad 500 for the sake of clarity. One of ordinary skill in the art would understand that each region of polishing pad 500 would have more than a single groove, in some embodiments. In comparison with polishing pad 300, polishing pad 500 includes each of first groove 212, second groove 232 and third groove 242 having a same width W1. Depth T1 is different from both of depth T2 and depth T3. Depth T2 is less than depth T3. Pitch S1 in central region 210 is different from at least one of pitch S2 or pitch S3. Pitch S2 is greater than pitch S3. Impacts of the geometric properties in polishing pad 500 are similar to those discussed above with respect to polishing pad 300 and are omitted here for the sake of brevity.

Figure 6:
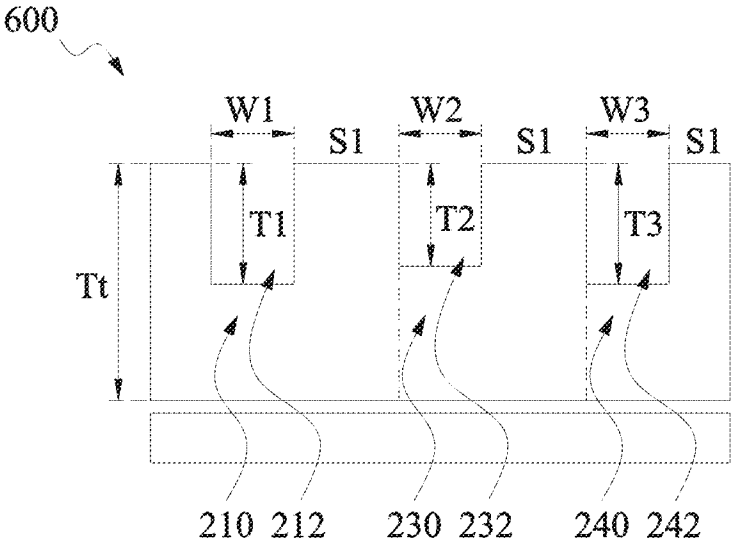
FIG. 6 is a cross-sectional view of a polishing pad, in accordance with some embodiments of the present disclosure.

FIG. 6 is a cross-sectional view of a portion of a polishing pad 600, in accordance with some embodiments. Polishing pad 600 is similar to polishing pad 300 and same reference numbers refer to same elements. The cross-sectional view of polishing pad 600 excludes portions of polishing pad 600 for the sake of clarity. One of ordinary skill in the art would understand that each region of polishing pad 600 would have more than a single groove, in some embodiments. In comparison with polishing pad 300, polishing pad 600 includes a same pitch S1 for each of central region 210, second transfer region 230 and retention region 240. Width W1 is different from at least one of width W2 or width W3. Width W2 is different from width W3. Depth T1 is different from both of depth T2 and depth T3. Depth T2 is less than depth T3. Impacts of the geometric properties in polishing pad 600 are similar to those discussed above with respect to polishing pad 300 and are omitted here for the sake of brevity.

Figure 7:
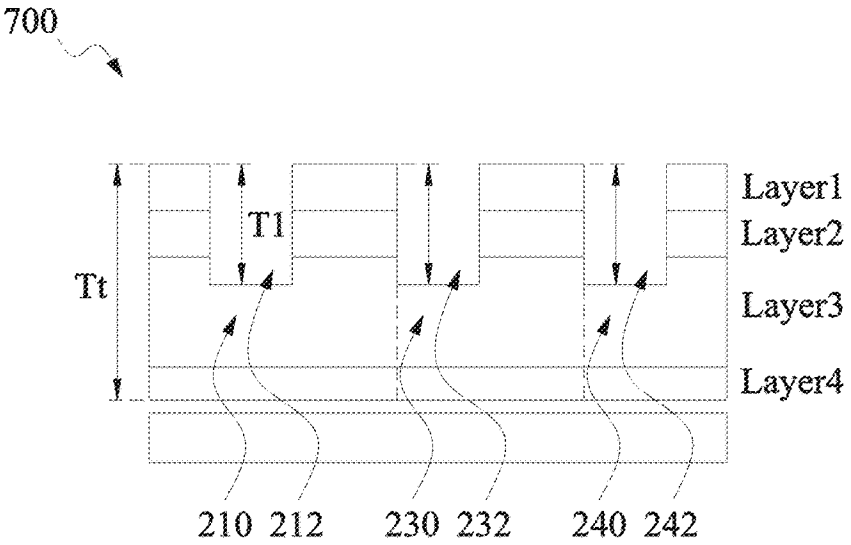
FIG. 7 is a cross-sectional view of a polishing pad, in accordance with some embodiments of the present disclosure.

FIG. 7 is a cross-sectional view of a portion of a polishing pad 700, in accordance with some embodiments. Polishing pad 700 is similar to polishing pad 300 and same reference numbers refer to same elements. The cross-sectional view of polishing pad 700 excludes portions of polishing pad 700 for the sake of clarity. One of ordinary skill in the art would understand that each region of polishing pad 700 would have more than a single groove, in some embodiments. In comparison with polishing pad 300, polishing pad 700 includes material properties which vary in a thickness direction.

Polishing pad 700 includes four layers of material. In some embodiments, polishing pad 700 includes more or less than four layers of material. Layer 1, layer 2, layer 3 and layer 4 independently have specific gravities ranging from about 0.5 to about 1.9. A specific gravity of layer 1, closest to a top surface of polishing pad 700, has a higher specific gravity than layer 4, farthest from the top surface of polishing pad 700. In some embodiments, at least one layer has a same specific gravity as at least one other layer. For example, in some embodiments, layer 2 has a same specific gravity as layer 4. In some embodiments, a specific gravity of layer 1 in central region 210 is different from a specific gravity of layer 1 in at least one of second transfer region 230 or retention region 240. Similar variations also occur for other layers, in some embodiments. In some embodiments, a specific gravity of one layer varies in a radial direction while a specific gravity of another layer remains substantially uniform in the radial direction.

A porosity and/or absorbance of layer 1 is lower than layer 4. In some embodiments, at least one layer has a same porosity and/or absorbance as at least one other layer. For example, in some embodiments, layer 2 has a same porosity as layer 4. In some embodiments, a porosity and/or absorbance of layer 1 in central region 210 is different from a porosity of layer 1 in at least one of second transfer region 230 or retention region 240. Similar variations also occur for other layers, in some embodiments. In some embodiments, a porosity and/or absorbance of one layer varies in a radial direction while a porosity and/or absorbance of another layer remains substantially uniform in the radial direction.

First groove 212, second groove 232 and third groove each have a same depth T1, a same width W1 and a same pitch S1. Variations in the material properties of polishing pad 700 help to impact the spread of slurry because a higher specific gravity in a top most layer helps to spread slurry at a more rapid rate in comparison with a polishing pad 700 having another arrangement.

Figure 8:
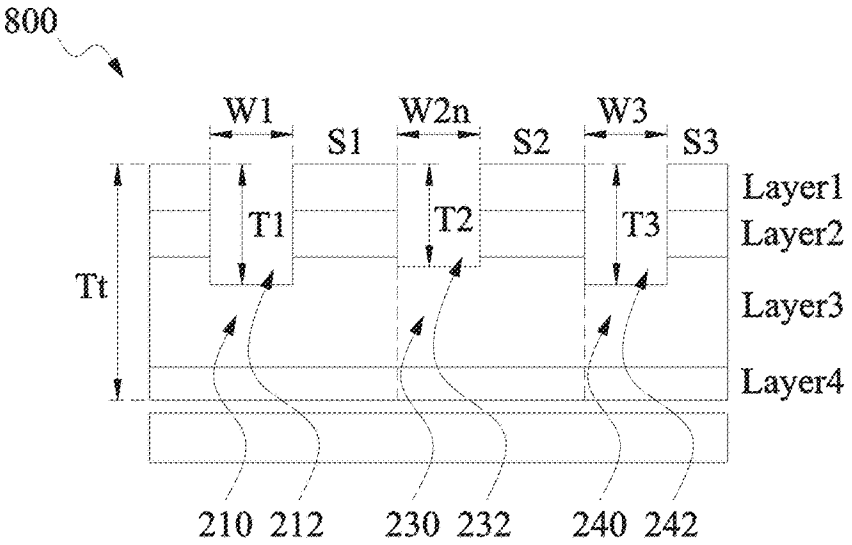
FIG. 8 is a cross-sectional view of a polishing pad, in accordance with some embodiments of the present disclosure.

FIG. 8 is a cross-sectional view of a portion of a polishing pad 800, in accordance with some embodiments. Polishing pad 800 is similar to polishing pad 300 and polishing pad 700 and same reference numbers refer to same elements. The cross-sectional view of polishing pad 800 excludes portions of polishing pad 800 for the sake of clarity. One of ordinary skill in the art would understand that each region of polishing pad 800 would have more than a single groove, in some embodiments. In comparison with polishing pad 300, polishing pad 800 includes material properties which vary in a thickness direction. In comparison with polishing pad 700, polishing pad 800 includes variable geometric properties across polishing pad 700.

A combination of variations of material properties and geometric properties helps to control spread of slurry across polishing pad 800 while also reducing slurry cast off from polishing pad 800.

Figure 9:
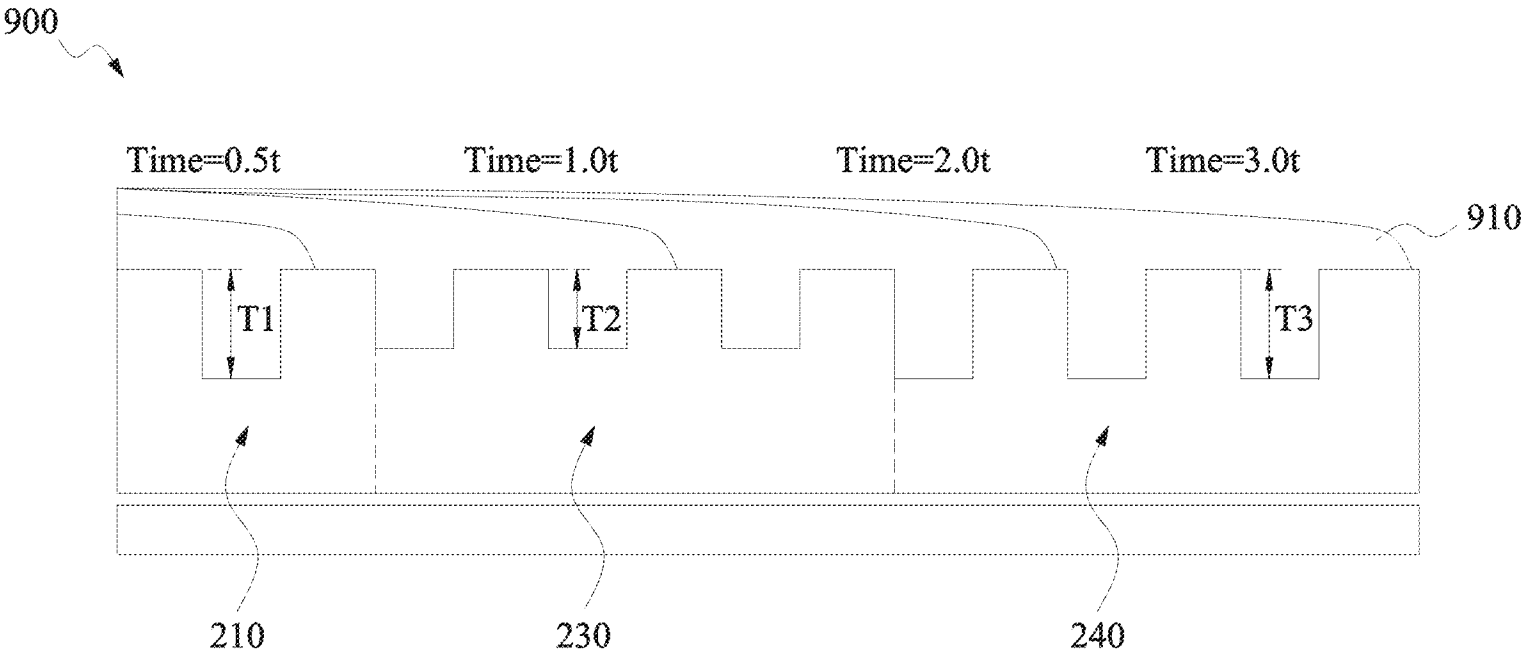
FIG. 9 is a cross-sectional view of a polishing pad including a slurry, in accordance with some embodiments of the present disclosure.

FIG. 9 is a cross-sectional view of a portion of a polishing pad 900 including a slurry 910, in accordance with some embodiments. Slurry 910 spreads across polishing pad 900 including central region 210, second transfer region 230 and retention region 240. In some embodiments, a number of grooves in the regions of polishing pad 900 differ from the number of grooves present in FIG. 9. Polishing pad 900 has substantially uniform material properties. In some embodiments, polishing pad 900 has variations in at least one material properties in at least one of a radial direction or a thickness direction. Polishing pad 900 has substantially uniform width W1 and pitch S1 in central region 210, second transfer region 230 and retention region 240. In some embodiments, at least one region of polishing pad 900 has a different width or pitch from at least one other region of polishing pad 900. A depth T1 of central region 210 is greater than a depth T2 of second transfer region 230. A depth T2 of second transfer region T2 is less than a depth T3 of retention region.

FIG. 9 includes a location of slurry 910 across polishing pad 900 at different time intervals. The time intervals are a measure of time from a start of a slurry dispensing. In some embodiments, the time unit t of the time intervals ranges from about 1 second to about 100 seconds. In comparison with other polishing pad arrangements, polishing pad 900 is able to spread slurry 910 to an edge of polishing pad 900 within three time intervals. Spreading slurry 910 to an edge of polishing pad 900 rapidly enough to impact removal of material at an edge of a wafer helps to achieve uniform planarization and increase production yield.

Figure 10:
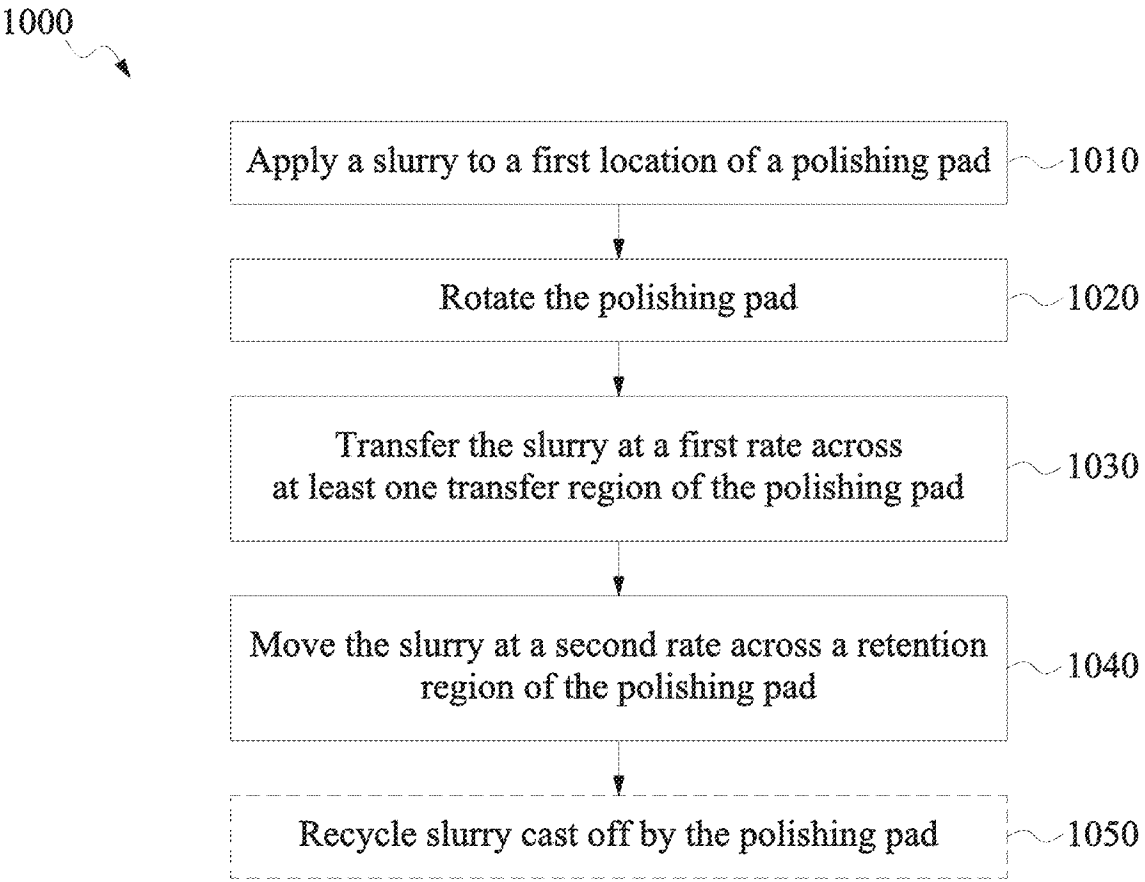
FIG. 10 is a flowchart of a method of using a polishing pad, in accordance with some embodiments of the present disclosure.

FIG. 10 is a flowchart of a method 1000 of using a polishing pad in accordance with some embodiments. In operation 1010, a slurry is applied to a first location of a polishing pad. In some embodiments, the slurry is applied to multiple locations of the polishing pad. In some embodiments, the first location is a center of the polishing pad. In some embodiments, the location is within a central region, e.g., central region 210 (FIG. 2), of the polishing pad.

In operation 1020, the polishing pad is rotated. The polishing pad is attached to a platen that is rotated by a motor in order to impart relative movement between the polishing pad and a wafer. In some embodiments, a rate of rotation of the polishing pad varies. For example, in some embodiments, a rate of rotation of the polishing pad is decreased after an initial startup time. The higher initial rotation rate of the polishing pad helps to spread the slurry to an edge of the polishing pad faster. The lower rotation rate following startup helps to reduce an amount of slurry cast off during a CMP process. In some embodiments, operation 1020 is performed simultaneously with operation 1010.

In operation 1030, the slurry is transferred across at least one transfer region of the polishing pad at a first rate. In some embodiments, the at least one transfer region of the polishing pad is first transfer region 220 and/or second transfer region 230 (FIG. 2). In some embodiments, the slurry is transferred across a first transfer region, e.g., first transfer region 220, at a different rate than across a second transfer region, e.g., second transfer region 230.

In operation 1040, the slurry moves across a retention region of the polishing pad at a second rate. The second rate is slower than the first rate. The lower second rate of transfer across the retention region, retention region 240 (FIG. 2), helps to reduce slurry cast off during the CMP process. The difference between the second rate and the first rate is a result of geometric and/or material properties variation between the at least one transfer region and the retention region.

In optional operation 1050, slurry which is cast off by the polishing pad is recycled and returned to the first location of the polishing pad. In some embodiments, at least one filtering or cleaning process is performed on the cast off slurry to remove debris and/or by-products from the slurry prior to returning the slurry to the first location. Operation 1050 is omitted in some embodiments, e.g., embodiments which do not reuse slurry.

Any of polishing pads 200, 300, 400, 500, 600, 700, 800 or 900 is usable with method 1000. In some embodiments, at least one operation of method 1000 is performed simultaneously with another operation. For example, in some embodiments, operation 1010 is performed simultaneously with operation 1020. In some embodiments, an order of operations is adjusted. For example, rotation of the polishing pad occurs prior to applying the slurry in some embodiments. In some embodiments, at least one operation of method 1000 is removed. For example, in some embodiments, operation 1050 is removed.

Method 1000 helps to improve production yield by rapidly transferring slurry to an edge of the polishing pad to provide a more uniform CMP process for edges of the wafer subjected to the CMP process. Method 1000 also helps to reduce manufacturing cost by reducing consumption of slurry during the CMP process. For example, in some embodiments, slurry consumption is decreased by about 10% to about 40% for a CMP process using the polishing pad of method 1000 in comparison with other polishing pad arrangements.

Figure 11:
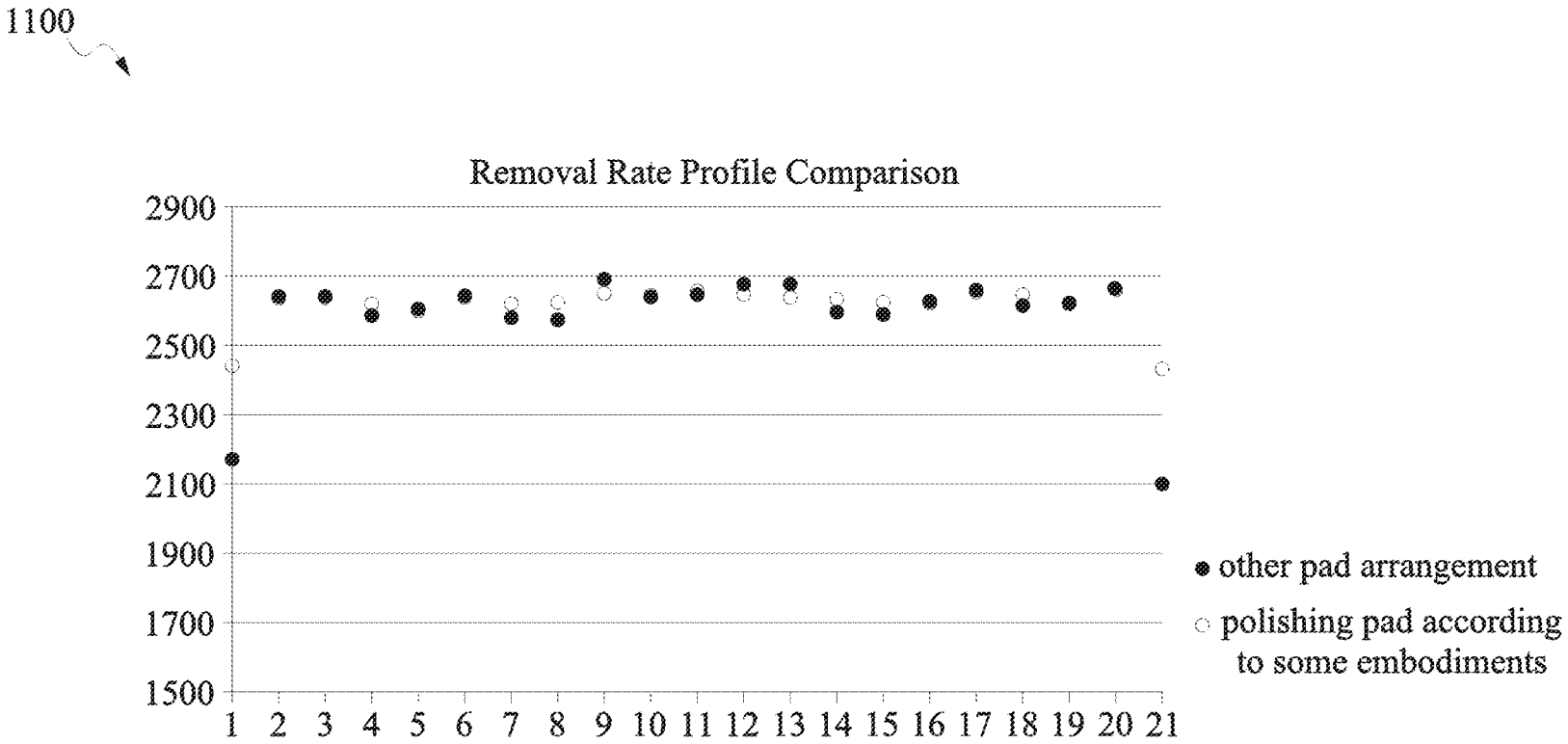
FIG. 11 is a graph of results of a planarization process using a polishing pad according to an embodiment in comparison with other polishing pad arrangements.

FIG. 11 is a graph 1100 of results of a planarization process using a polishing pad in comparison with other polishing pad arrangements, in accordance with some embodiments. The removal rate on the Y-axis provides information regarding how quickly material is removed from a wafer. The site locations on the X-axis provide information regarding a location on the wafer from one edge, site 1, to an opposite edge, site 21, across a diameter of the wafer. Graph 1100 indicates that for non-edge regions of the wafer, removal rates remain substantially constant. However, by using a polishing pad according to some embodiments of the present disclosure, removal rates at the edges, site 1 and site 21, are significantly improved in comparison with removal rates for other pad arrangements. The improved removal rate is much closer to the removal rate in the non-edge regions of the wafer. As a result, the ability to manufacture usable products at an edge of the wafer is increased by the polishing pad according to some embodiments of the current disclosure in comparison with other pad arrangements. The ability to increase a number of usable products on wafer increases manufacturing yield.

An aspect of this description relates to a method of using a polishing pad. The method includes applying a slurry to a first location on the polishing pad. The method further includes rotating the polishing pad. The method further includes spreading the slurry across a first region of the polishing pad at a first rate, wherein the first region includes a plurality of first grooves. The method further includes spreading the slurry across a second region, surrounding the first region of the polishing pad at a second rate different from the first rate, wherein the second region includes a plurality of second grooves. The method further includes spreading the slurry across a third region, surrounding the second region of the polishing pad at a third rate less than the first rate and the second rate, wherein the third region includes a plurality of third grooves. In some embodiments, spreading the slurry across the second region includes spreading the slurry across the second region having a first material property of the first region that varies in a thickness direction of the polishing pad, each of the plurality of second grooves extends through at least two variations in the first material property, and the first material property comprises porosity, specific gravity or absorbance. In some embodiments, spreading the slurry across the third region includes spreading the slurry across the plurality of third grooves, and each of the plurality of third grooves is wider than each of the plurality of second grooves. In some embodiments, spreading the slurry across the third region includes spreading the slurry across the plurality of third grooves, and each of the plurality of third grooves is deeper than each of the plurality of second grooves. In some embodiments, spreading the slurry across the third region includes spreading the slurry across the plurality of third grooves, and each of the plurality of third grooves is wider than each of the plurality of first grooves. In some embodiments, spreading the slurry across the third region includes spreading the slurry across the plurality of third grooves, and each of the plurality of third grooves is deeper than each of the plurality of first grooves. In some embodiments, spreading the slurry across the third region includes spreading the slurry across the third region having a higher porosity than the second region.

An aspect of this description relates to a method of using a polishing pad. The method includes applying a slurry to a first location on the polishing pad. The method further includes rotating the polishing pad. The method further includes spreading the slurry across a first region of the polishing pad at a first rate, wherein the first region has a first porosity. The method further includes spreading the slurry across a second region, surrounding the first region of the polishing pad at a second rate different from the first rate, wherein the second region has a second porosity. The method further includes spreading the slurry across a third region, surrounding the second region of the polishing pad at a third rate less than the first rate and the second rate, wherein the third region has a third porosity. In some embodiments, spreading the slurry across the first region includes spreading the slurry across the first region comprises a plurality of first grooves. In some embodiments, spreading the slurry across the second region includes spreading the slurry across the second region comprising a plurality of second grooves. In some embodiments, spreading the slurry across the third region includes spreading the slurry across the third region comprising a plurality of third grooves. In some embodiments, spreading the slurry across the third region includes spreading the slurry across the third region comprising the plurality of third grooves having a same depth as the plurality of first grooves. In some embodiments, spreading the slurry across the third region includes spreading the slurry across the third region comprising the plurality of third grooves having a different depth from the plurality of first grooves. In some embodiments, spreading the slurry across the third region includes spreading the slurry across the third region comprising the plurality of third grooves having a same width as the plurality of first grooves. In some embodiments, spreading the slurry across the third region includes spreading the slurry across the third region comprising the plurality of third grooves having a different width from the plurality of first grooves.

An aspect of this description relates to a method of using a polishing pad. The method includes applying a slurry to a first location on the polishing pad. The method further includes rotating the polishing pad. The method further includes spreading the slurry across a first region of the polishing pad at a first rate, wherein the first region comprises a plurality of first grooves, and each of the plurality of first grooves has a first width and a first depth. The method further includes spreading the slurry across a second region, surrounding the first region of the polishing pad at a second rate different from the first rate, wherein the second region comprises a plurality of second grooves, and each of the plurality of second grooves has a second width and a second depth. The method further includes spreading the slurry across a third region, surrounding the second region, of the polishing pad at a third rate less than the first rate and the second rate, wherein the third region comprises a plurality of third grooves, each of the plurality of third grooves has a third width and a third depth, and the third width is different from at least one of the first width or the second width. In some embodiments, spreading the slurry across the third region includes spreading the slurry across the third region comprising the plurality of third grooves having the third depth different from at least one of the first depth or the second depth. In some embodiments, spreading the slurry across the second region includes spreading the slurry across the second region comprising the plurality of second grooves having the second depth different from the first depth. In some embodiments, spreading the slurry across the second region includes spreading the slurry across the second region comprising the plurality of second grooves having the second width different from the first width. In some embodiments, spreading the slurry across the third region includes spreading the slurry across the third region having a third porosity different from a first porosity of the first region and a second porosity of the second region.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method of using a polishing pad, the method comprising:

applying a slurry to a first location on the polishing pad;

rotating the polishing pad;

spreading the slurry across a first region of the polishing pad at a first rate, wherein the first region comprises a plurality of first grooves;

spreading the slurry across a second region, surrounding the first region of the polishing pad at a second rate different from the first rate, wherein the second region comprises a plurality of second grooves; and spreading the slurry across a third region, surrounding the second region of the polishing pad at a third rate less than the first rate and the second rate, wherein the third region comprises a plurality of third grooves.

2. The method of claim 1, wherein spreading the slurry across the second region comprises spreading the slurry across the second region having a first material property of the first region that varies in a thickness direction of the polishing pad, each of the plurality of second grooves extends through at least two variations in the first material property, and the first material property comprises porosity, specific gravity or absorbance.

3. The method of claim 1, wherein spreading the slurry across the third region comprises spreading the slurry across the plurality of third grooves, and each of the plurality of third grooves is wider than each of the plurality of second grooves.

4. The method of claim 1, wherein spreading the slurry across the third region comprises spreading the slurry across the plurality of third grooves, and each of the plurality of third grooves is deeper than each of the plurality of second grooves.

5. The method of claim 1, wherein spreading the slurry across the third region comprises spreading the slurry across the plurality of third grooves, and each of the plurality of third grooves is wider than each of the plurality of first grooves.

6. The method of claim 1, wherein spreading the slurry across the third region comprises spreading the slurry across the plurality of third grooves, and each of the plurality of third grooves is deeper than each of the plurality of first grooves.

7. The method of claim 1, wherein spreading the slurry across the third region comprises spreading the slurry across the third region having a higher porosity than the second region.

8. A method of using a polishing pad, the method comprising:

applying a slurry to a first location on the polishing pad;

rotating the polishing pad;

spreading the slurry across a first region of the polishing pad at a first rate, wherein the first region comprises a plurality of first grooves, and each of the plurality of first grooves has a first width and a first depth;

spreading the slurry across a second region, surrounding the first region of the polishing pad at a second rate different from the first rate, wherein the second region comprises a plurality of second grooves, and each of the plurality of second grooves has a second width and a second depth; and spreading the slurry across a third region, surrounding the second region of the polishing pad at a third rate less than the first rate and the second rate, wherein the third region comprises a plurality of third grooves, each of the plurality of third grooves has a third width and a third depth, and the third width is different from at least one of the first width or the second width.

9. The method of claim 8, wherein spreading the slurry across the third region comprises spreading the slurry across the third region comprising the plurality of third grooves having the third depth different from at least one of the first depth or the second depth.

10. The method of claim 8, wherein spreading the slurry across the second region comprises spreading the slurry across the second region comprising the plurality of second grooves having the second depth different from the first depth.

11. The method of claim 8, wherein spreading the slurry across the second region comprises spreading the slurry across the second region comprising the plurality of second grooves having the second width different from the first width.

12. The method of claim 8, wherein spreading the slurry across the third region comprises spreading the slurry across the third region having a third porosity different from a first porosity of the first region and a second porosity of the second region.

* * * * *